US007402795B2

(12) United States Patent
Getin et al.

(10) Patent No.: US 7,402,795 B2
(45) Date of Patent: Jul. 22, 2008

(54) PARTICLE SORTING METHOD

(75) Inventors: Stephane Getin, Grenoble (FR); Alexandra Fuchs, Beaulieu (FR); Guillaume Colas, Grenoble (FR); Stephanie Gaugiran, Grenoble (FR)

(73) Assignee: Commissariat a l'Energie Atomique, Paris (FR)

( * ) Notice: Subject to any disclaimer, the term of this patent is extended or adjusted under 35 U.S.C. 154(b) by 210 days.

(21) Appl. No.: 10/581,199

(22) PCT Filed: Dec. 3, 2004

(86) PCT No.: PCT/EP2004/053260

§ 371 (c)(1),
(2), (4) Date: Jun. 1, 2006

(87) PCT Pub. No.: WO2005/054832

PCT Pub. Date: Jun. 16, 2005

(65) Prior Publication Data

US 2007/0125940 A1 Jun. 7, 2007

(30) Foreign Application Priority Data

Dec. 4, 2003 (FR) ..... 03 50972

(51) Int. Cl.
*H05H 3/04* (2006.01)

(52) U.S. Cl. ..... 250/251; 385/12

(58) Field of Classification Search ..... None
See application file for complete search history.

(56) References Cited

U.S. PATENT DOCUMENTS

| | | | |
|---|---|---|---|
| 5,858,192 | A | 1/1999 | Becker et al. |
| 5,888,370 | A | 3/1999 | Becker et al. |
| 5,993,630 | A | 11/1999 | Becker et al. |
| 5,993,632 | A | 11/1999 | Becker et al. |

(Continued)

FOREIGN PATENT DOCUMENTS

| | | |
|---|---|---|
| DE | 198 60 118 | 9/2000 |
| EP | 1 324 645 | 7/2003 |
| WO | 00 00292 | 1/2000 |
| WO | 00 37920 | 6/2000 |
| WO | 00 69565 | 11/2000 |

OTHER PUBLICATIONS

Kawata, S. et al., "Optically Driven Mie Particles in an Evanescent Field Along a Channeled Waveguide", Optics letters, vol. 21, No. 21, pp. 1768-1770, 1996.

(Continued)

*Primary Examiner*—Jack I Berman
(74) *Attorney, Agent, or Firm*—Oblon, Spivak, McClelland, Maier & Neustadt, P.C.

(57) ABSTRACT

A method for sorting particles, including: marking the particles to modify their optical index, placing the particles on a waveguide of a support, and injecting light radiation into the waveguide, the injecting causing displacement of particles on the waveguide and separation of the particles.

11 Claims, 8 Drawing Sheets

U.S. PATENT DOCUMENTS

| | | | | |
|---|---|---|---|---|
| 6,833,542 | B2 * | 12/2004 | Wang et al. | 250/251 |
| 6,936,811 | B2 * | 8/2005 | Kibar | 250/251 |
| 7,241,988 | B2 * | 7/2007 | Gruber et al. | 250/251 |
| 2007/0086701 | A1 * | 4/2007 | Getin et al. | 385/37 |

OTHER PUBLICATIONS

Tanaka, Takuo et al., "Optically Induced Meandering Mie Particles driven by the beat of Coupled Guided Modes Produced in a Multimode waveguide", Japanese Journal of Applied Physics, vol. 41, No. 3A, pp. 260-262, Mar. 1, 2002.

Ashkin, A. et al., "Observation of Radiation-Pressure Trapping of Particles by Alternating Light Beams", The American Physical Society, vol. 54, No. 12, pp. 1245-1248, 1985.

Ng. et al."Propulsion of Gold Nanoparticles on Optical Waveguides", Optics communications, vol. 208, pp. 117-124, 2002.

Ng. et al.,"Manipulation of Colloidal Gold Nanoparticles in the Evanescent Field of a Channel Waveguide", Applied Physics letters, vol. 76, No. 15, pp. 1993-1995, 2000.

* cited by examiner

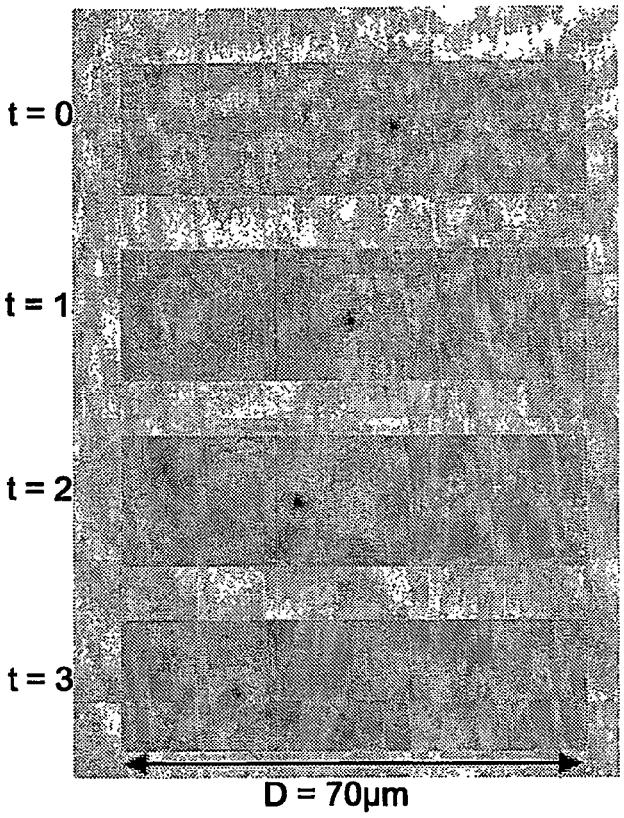
FIG. 10A
FIG. 10B
FIG. 10C
FIG. 10D
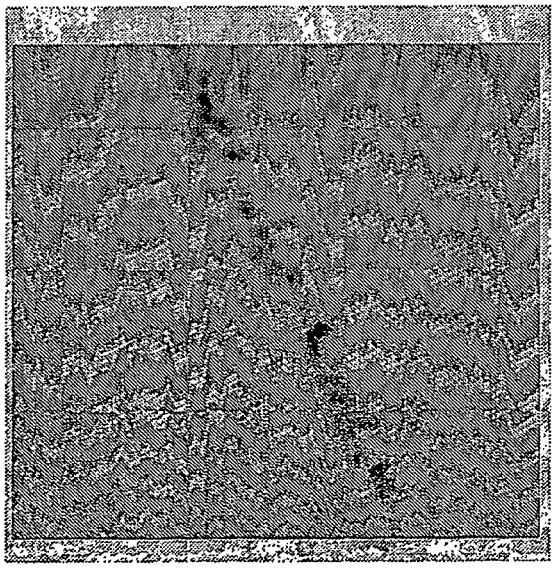
FIG. 11

PARTICLE SORTING METHOD

TECHNICAL DOMAIN AND PRIOR ART

This invention relates to the domain of sorting and analysis of small particles. These particles may be biological particles such as liposomes, animal or vegetable cells, viruses or micro-organisms, macromolecules, for example such as DNA, RNA or proteins, or inorganic particles such as microballs. Application domains may then be chemical or biomedical analysis or quality control (calibration of micro-particles).

Known approaches in terms of particle cell sorting, such as flow cytometry, have limits particularly for the analysis of rare or very minority cell populations, and for manipulation of particles smaller than 1 micron.

The technique of optical clamps is based on the confinement of a particle (microball, or cell or macromolecule) by the intensity gradient generated at the waist of a continuous laser beam. For example, it is described in the article by "Ashkin and Dziedic" entitled "Observation of radiation-pressure trapping of particles by alternating light beams" published in Physics Review Letters, 54(12), 1985. This operation is made possible by balancing of radiation pressures. Once this operation has been done, the particle is displaced by displacing the beam.

Thus, displacement distances on this type of device are usually limited to a few hundred microns.

Finally, it is impossible to sort metallic particles.

FIG. 1 shows the principle of such a device.

A particle 2 is confined by a beam 4 in a liquid medium 6.

FIG. 2 is a diagram showing a force field generated by the device, on each side of the laser beam 4; the particle is confined in a mechanical force field (induced by the radiation pressure provoked by the electrical field of the laser) which makes it possible to trap it.

This type of device has two disadvantages: displacement of particles is based on use of a dedicated mechanical system, which may be difficult and expensive to set up.

Moreover, it is impossible to make any type of separation of species as a function of their shape or size characteristics.

Recent work, for example such as that described in the article by T. Tanaka et al, published in Applied Physics Letters, Vol. 77, p. 3131, 2000, makes use of guided optical devices, and suggests the possibility of designing a device for displacement of cells by optical forces; this technique is limited to objects very much smaller than a biological cell (balls and colloids with a size of the order of a few microns).

As illustrated in FIG. 3, this device uses a waveguide 10 with a strip made on a substrate 12. A particle is displaced by a force with photonic pressure, which is proportional to the light intensity at the particle. The particle is held in place in the guide by a force that is proportional to the gradient of the intensity.

If the waveguide is single mode, there is a maximum light intensity at the location at which the particle will be trapped.

The problem arises of finding a method and a device for sorting particles simply and efficiently.

PRESENTATION OF THE INVENTION

The invention relates to systems for sorting particles or objects, for example with biological interest.

The invention firstly relates to a particle sort method comprising steps including:

a) placement of said particles on at least one waveguide of a support, b) injection of light radiation through the said waveguide, for displacement of particles on said waveguide and separation of the particles.

The particles can then form clusters as a function of their properties.

A step carried out before particles are marked to modify their optical index.

For example particles to be sorted may be cells or macromolecules or microballs.

The radiation used may be in a spectral range between near ultraviolet and infrared, and preferably the infrared for biological cells.

BRIEF DESCRIPTION OF THE FIGURES

This invention will be better understood after reading the description of example embodiments given purely for information purposes and in no way limitative, with reference to the appended figures wherein:

FIGS. 10A to 12C show experimental results.

Identical, similar or equivalent parts of the different figures are marked with the same numeric references so as to facilitate comparison between one figure and the others.

The different parts shown in the figures are not necessarily at the same scale, to make the figures more easily readable.

DETAILED PRESENTATION OF PARTICULAR EMBODIMENTS

Figure 1:
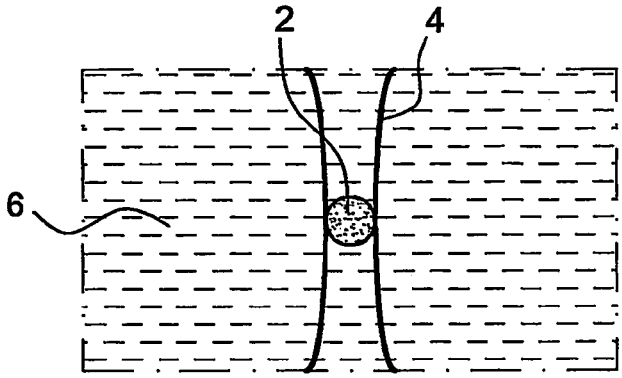
FIGS. 1, 2 and 3 illustrate known techniques.
Figure 2:
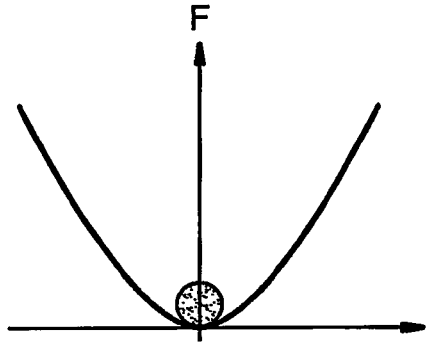
Figure 3:
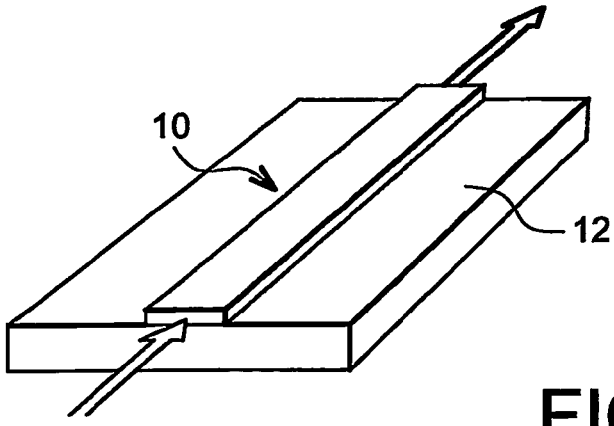
Figure 4A:
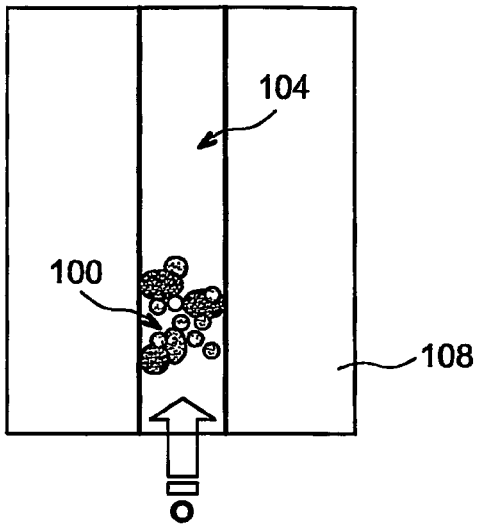
FIGS. 4A and 4B, 5A and 5B, 6A and 6B show various examples of sort methods according to the invention.

A general example of the method according to this invention will now be described with reference to FIGS. 4A and 4B. This method is used to sort a group of particles depending on their physical properties. Particles means organic or inorganic elements or objects with a size varying from 5 nanometers to 100 micrometers. These particles may for example be biological elements such as animal or vegetable cells, macromolecules such as proteins, DNA, RNA.

Particles may also be micro-objects, for example such as microballs.

Physical properties means properties such as the size, mass, optical properties such as the refraction index of these particles.

The first step in sorting a group of particles 100 is to place this group firstly on an optical waveguide 104 formed in a support 108.

The assembly may possibly be immersed in a liquid medium, for example water (index about 1.33). For biological applications, this liquid may also be a buffer solution or a cell suspension medium, for which the index is also close to 1.33.

To make the sort method more efficient, the support, the waveguide and the medium in which the support is located preferably have optical indexes different or very different from the values for the particles that are to be sorted.

For example, the support 108 may be based on a transparent material such as glass or it may be based on a semi conducting material such as silicon. The waveguide 104 may be multi-mode or single mode (FIG. 4A). The waveguide may extend over a length between a few micrometers and several centimeters on the support 108.

The group of particles 100 may be placed firstly in an area of the waveguide 104, using a manual or automated method.

Then, using an optical device that may or may not be integrated into the support 108, light radiation R is injected into the waveguide 104. This radiation may be injected for a predetermined time, for example of the order of a few seconds to a few minutes.

The injected radiation has a wavelength between the near ultraviolet and infrared, for example between 300 nm and 1200 nm. For biological particles or cells, wavelengths in the infrared will be used, for example a wavelength of 1064 nm of a YAG laser. The injected power could be of the order of a few tens of milliwatts to a few hundred milliwatts, for example between 50 mW and 1 W, for example close to 150 mW.

Therefore, the radiation will be chosen depending on the nature and also the size of the particles to be sorted.

Passage of light radiation through the waveguide 104 creates an evanescent wave on the guide surface. This wave displaces particles located above the guide, by scattering of light on these particles. Displacement is done along the waveguide, along the direction of propagation of the light radiation.

Particles then displace at different velocities and along different lengths from each other, depending on the size, mass and optical index of each.

Particle movements can be stopped after a certain radiation light injection time. The particles are then displaced along different corresponding lengths along the waveguide 104 depending on their size and/or their mass and/or their refraction index.

The displacement lengths may for example vary from several hundred nanometers to a few centimeters.

Figure 4B:
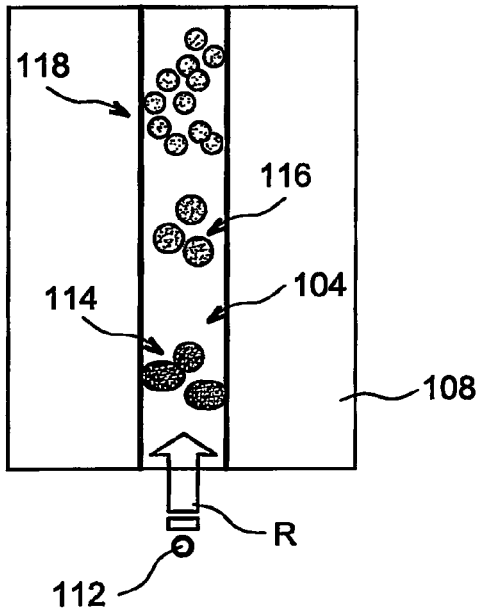

Particles are then usually grouped into several clusters 114, 116, 118 each occupying a more or less extensive surface on the waveguide 104 (FIG. 4B). The displacement length of each particle is characteristic of its physical properties, therefore particles in one cluster have some similar physical properties, or the same properties.

Particles with identical compositions but different sizes can thus be sorted, and particles with the same or approximately the same size but with different physical compositions and/or properties can also be sorted.

Figure 5A:
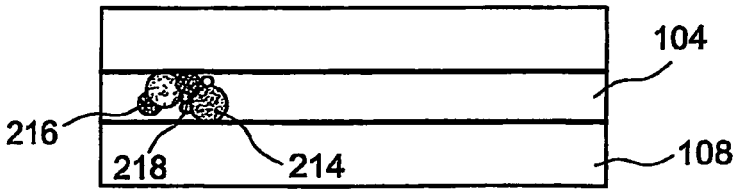
Figure 5B:
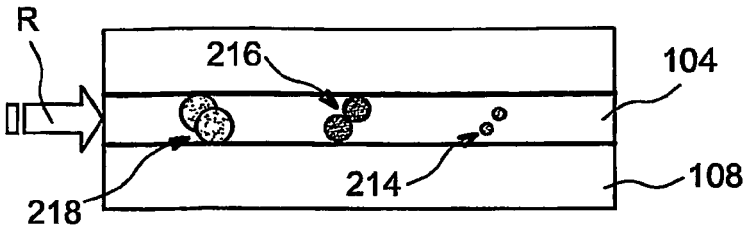

FIG. 5A illustrate the first case; particles 214, 216, 218 with different sizes will have different behaviours under the influence of evanescent radiation, and can thus be sorted (FIG. 5B).

Figure 6A:
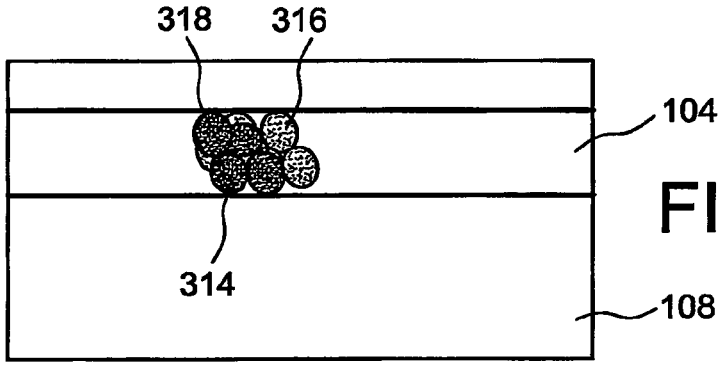
Figure 6B:
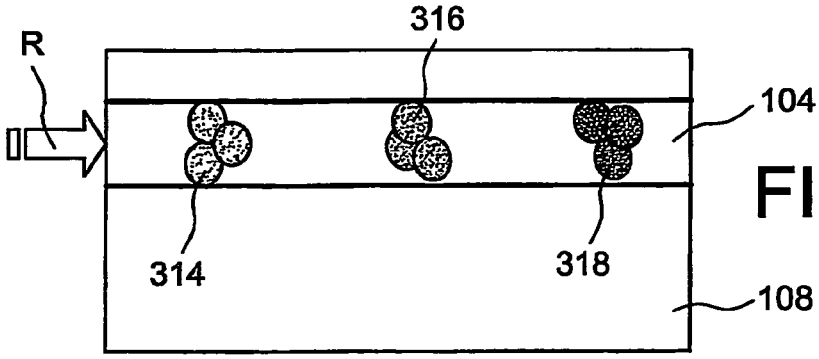

According to another example, particles with different refraction indexes will have different behaviours under the influence of evanescent radiation. This example is illustrated in FIGS. 6A and 6B in which particles 314, 316, 318, initially mixed (FIG. 6A) with comparable sizes but different indexes will be sorted progressively using a method according to the invention (FIG. 6B).

According to yet another example in the infrared domain, living cells or biological particles have an index (about 1.37 for cytoplasm, 1.39 for a nucleus, 1.42 for mitochondria as indicated in the "three dimensional computation of light scattering cells" given in the publication by A. Dunn and R. Richards-Kortum, published in the IEEE Journal of selected topics in quantum electronics vol. 2, No. 4, December 1996) similar of the value for water (about 1.33), while smaller gold particles have a much smaller index (about 0.3 at the wavelength of 1064 nm) and have higher absorption (the imaginary part of the index being approximately equal to 7) at the above mentioned wavelength.

Gold particles will be more easily displaced by evanescent radiation, which will have a greater effect on gold particles than on cells, although the cells are larger than the gold particles.

For some applications, it may be advantageous to mark cells, for example with gold particles, which can increase the difference in the optical index between the assembly composed of each cell and its marking particles, and its environment. For biological cells, polymer particles can be used instead of small gold particles, or any other material can be used on which biological objects can be grafted; once again, these particles are smaller than the cells, and their index is more different from the index of a medium such as water, and can be used as markers.

According to another example of a method according to this invention, the particles considered are animal or vegetable cells that are to be sorted, for example depending on their size.

The support on which the sorting is done may be immersed in a liquid solution, preferably a biocompatible solution to protect the cells.

The cell sort can be improved firstly by marking these cells in order to modify their optical index and so that they can be more reactive to the sort method according to the invention.

The optical index of the cells thus marked will preferably be very different from the optical index of the support and the waveguide, and from the medium in which the support is placed.

The marking may be for example done using metallic balls or polymer balls that are attached or that are grafted to said cells, for example using the antigen antibody model or biotin/streptavidin antibody model.

A group of marked cells is sampled firstly, for example, using a pipette. The next step is to place said sample in a support receptacle. This receptacle may be a chamber, for example such as a Gene Frame® type chamber. The receptacle is preferably impermeable to gas and thermally isolates the cells.

The cells group may be transferred from the receptacle to a zone placed on the waveguide, for example using one or several capillaries.

The next step is to inject light radiation R into the waveguide 104 for a predetermined duration, for example of the order of a few minutes. The radiation used during a cell sort would preferably be inoffensive towards the cells. Thus, the light radiation used may be laser radiation emitting at a wavelength between far red and near infrared, for example between 1000 nm and 1200 nm, for example close to 1064 nm.

Passage of light radiation through the waveguide creates an evanescent wave that displaces cells on the guide along an axis transverse to the guide, along the direction of propagation of light radiation. The cells are then displaced at velocities different to each other depending on the size of each cell.

When the predetermined injection duration has elapsed, the cell movement stops. The cells are grouped in several clusters 314, 316, 318 as illustrated in FIG. 6B, and are located at different average distances from the start zone.

A device for the sorting method according to the invention and including a support and one or several waveguides like those described above, may be integrated for example in a MEMS (micro-electromechanical system) or in a lab on a chip.

A waveguide such as those described above can for example be made by a thin layer manufacturing method, or for example by an ion exchange method.

Figure 7A:
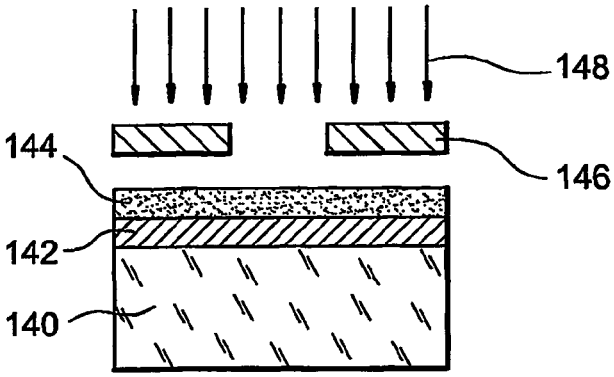
FIGS. 7A to 7D, 8 show steps in the manufacture of waveguides that can be used in sort methods according to the invention.

Firstly (FIG. 7A), a layer of aluminium 142 (obtained for example by evaporation or sputtering), is deposited on a glass surface 140 followed by a layer 144 of photoresist resin (deposition by Spin Coating). A chromium lithography mask 146 is then brought into contact with the resin layer under a vacuum. The mask represents the negative of the final pattern (the waveguide).

The mask is then illuminated using incoherent radiation 148 for which the central wavelength is for example located at about 350 nm and for which the resin is a photoresist resin. The chemical structure of the part that is not concealed by the mask is modified.

Figure 7B:
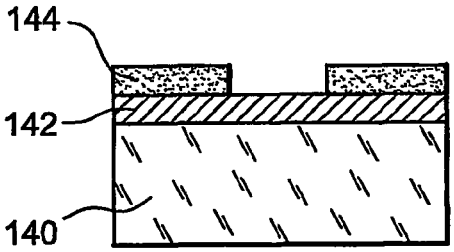

The support is then dipped into a solution that will develop the resin 144. Thus, the areas on which the chemical structure was modified by insolation are etched (FIG. 7B).

Figure 7C:
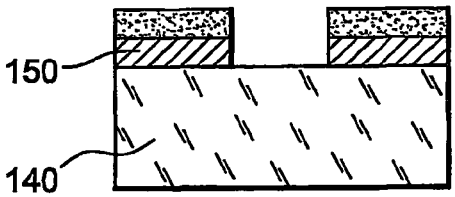

The plate is then dipped in an aluminium etching solution (AluEtch). This solution does not etch the resin. Thus, only the previously developed parts are etched (FIGS. 7C).

Figure 7D:
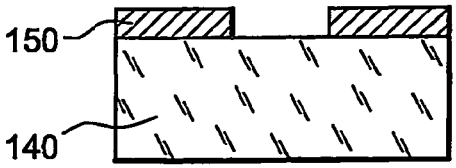

Finally, the resin is dissolved in acetone. Only the pattern 150 remains on the plate (FIG. 7D).

Figure 8:
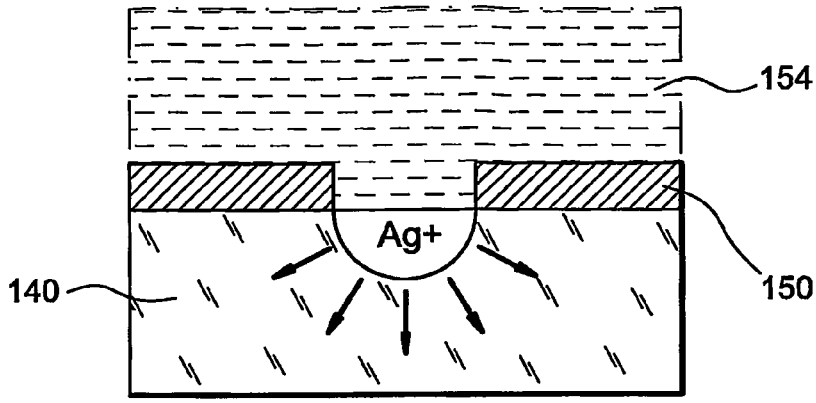

An ion exchange step is then carried out to form the waveguides. The support is then immersed in a salt bath containing silver nitrate and sodium nitrate. The proportion between these salts determines the silver content that is exchanged in the glass 140. The bath generally contains between 10% and 50% of silver depending on the application. Since the salt melting temperature is about 310° C., the exchange step is carried out at between 320° C. and 350° C. (FIG. 8).

The aluminium mask is then removed for example by etching.

Annealing can possibly be done; the glass plate is heated without any contact with a bath. This step enables silver ions to penetrate more deeply towards the inside of the glass support. A waveguide can be formed in this way.

Braking forces on particles caused by friction with the upper surface of the guide can be reduced, by coating the guide with a special coating, for example a thin Teflon based layer.

One example application can be described in biology.

In a heterogeneous cell sample, an attempt is made to isolate a given sub-population characterised by a specific phenotype, for example the presence of a certain type of surface macromolecules, for example such as proteins. Furthermore, probe molecules such as antibodies are available capable of recognising and bonding with these phenotypic markers with a very strong affinity. In the case of antibody type probe molecules, the phenotypic markers are called antigens. Antibodies are fixed by means known to those skilled in the art to balls chosen for their particular characteristics, for example gold balls. These functionalised gold balls are then grafted onto the surface of cells, for example these cells may be lymphocytes isolated from blood and that are to be sorted.

The marked cells are deposited in a chamber, on a support (for example by a focusing device integrated into the cover). The chamber may for example be a device of the Gene Frame® type (Abgene®).

This small self-sticking chamber is very simple and has a joint system impermeable to gas, providing resistance at high temperatures up to 97° C., and prevents the loss of reagent due to evaporation. It is usually used for hybridising and in situ amplification procedures in biology.

Laser light is injected into the guide. The chosen wavelength is within the far red/near infrared range, a transparent biological spectral region that ensures viability of cells after treatment; (no biological molecules or water are absorbed). Cells and unfixed balls are sorted as described above.

Marked cells are displaced to an analysis/recuperation window. Biological particles may be recovered, for example by fluid means (recuperation by capillary) or more conventional means (recuperation by pipette at a recuperation chamber adapted to the size of the cone).

In general, observation means may be provided, for example a CCD camera located above the guide 108. These means enable monitoring of the sort made as described above.

Figure 9:
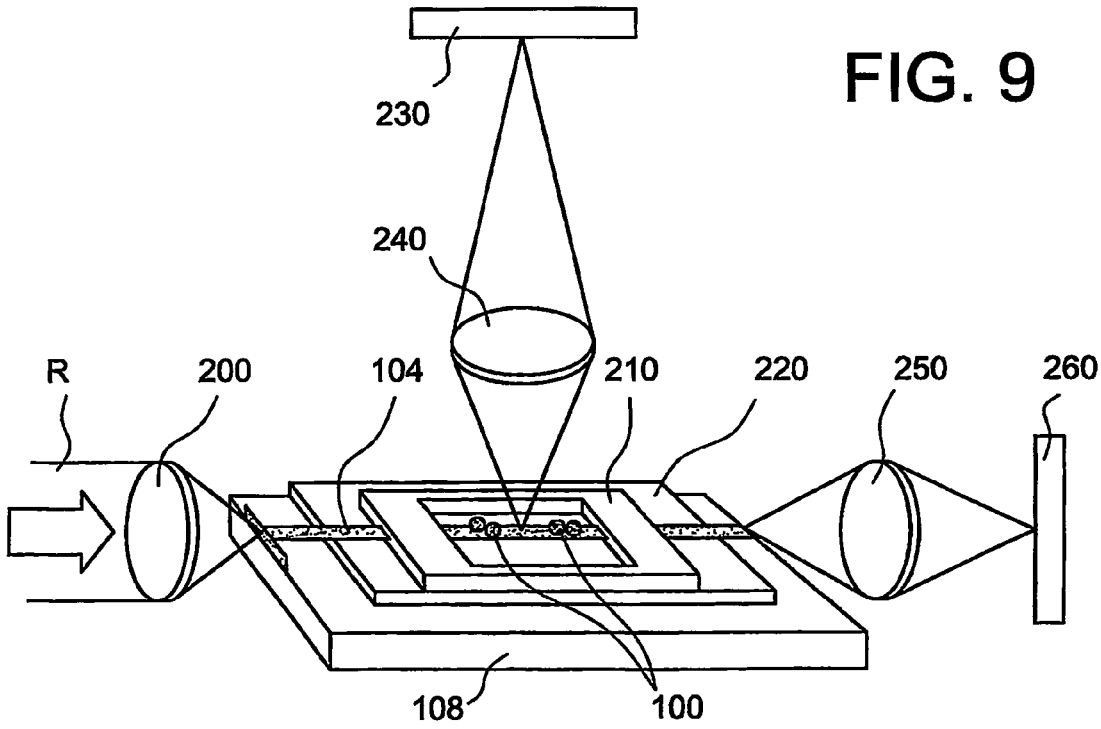
FIG. 9 shows a device for observing the sort method according to the invention.

FIG. 9 shows a particle sorting system 100 on a support 108 incorporating a guide system according to the invention. An objective 300 focuses a laser beam R (for example a YAG beam at 1064 nm) in a guide 104. The particles to be sorted are contained in a 30 chamber 210 located on a slide 220. A camera 230 is used to make an image of the sort, for example using a focusing device or a zoom 240. Means 250, 260 (objective, camera) of forming an image of the transmitted radiation may also be placed at the output from the device.

The invention is applicable not only to sorting of marked cells, but also to other domains, for example calibration of balls or microballs, particularly made of latex or gold.

Another example embodiment will be given. In this example, the waveguides used are surface guides made by a potassium ion exchange (glass slide substrate). These ions are produced at a temperature of 280° C. for an exchange time of 2 h 15. Losses of these guides are of the order of 0.2 to 0.5 dB/cm at a wavelength of 1064 nm.

The displaced particles to be sorted are glass balls with a refraction index of 1.55 and a diameter of 2 μm, or gold balls with a diameter of 1 μm.

The device used is of the type shown in FIG. 9. Light is coupled through the edge using a continuous YAG laser at 1064 nm (P=10 W) and balls are observed through the top using a zoom system 240 coupled to a video camera 230 for monitoring their displacement.

Figures 12A, 12B, 12C:
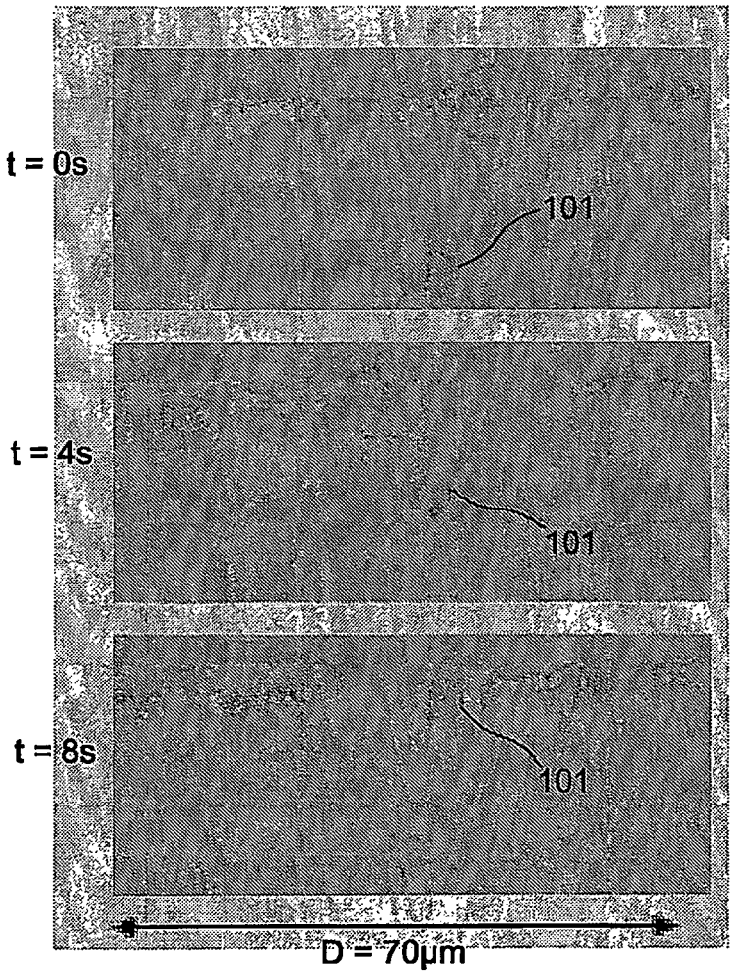

Experiments carried out on 1 μm diameter gold balls have demonstrated spontaneous grouping of balls on the guide followed by their displacement at velocities of the order of 4 μm/s along the guide. Similarly, the possibility of grouping and displacing glass balls is demonstrated. Thus, FIGS. 10A to 12C illustrate:

- FIGS. 10A to 10D; displacement of metallic particles over a distance of 70 μm, at t=0 s, 2 s, 3 s.
- FIG. 11: a metallic particles concentration effect.
- FIGS. 12A to 12C: progressive grouping of glass balls 101 along a 70 μm portion of the guide, at t=0 s, 4 s, 8 s successively.

These results may advantageously be used in the context of a method according to the invention, due to grouping of particles that facilitates sorting.

Figure 13A:
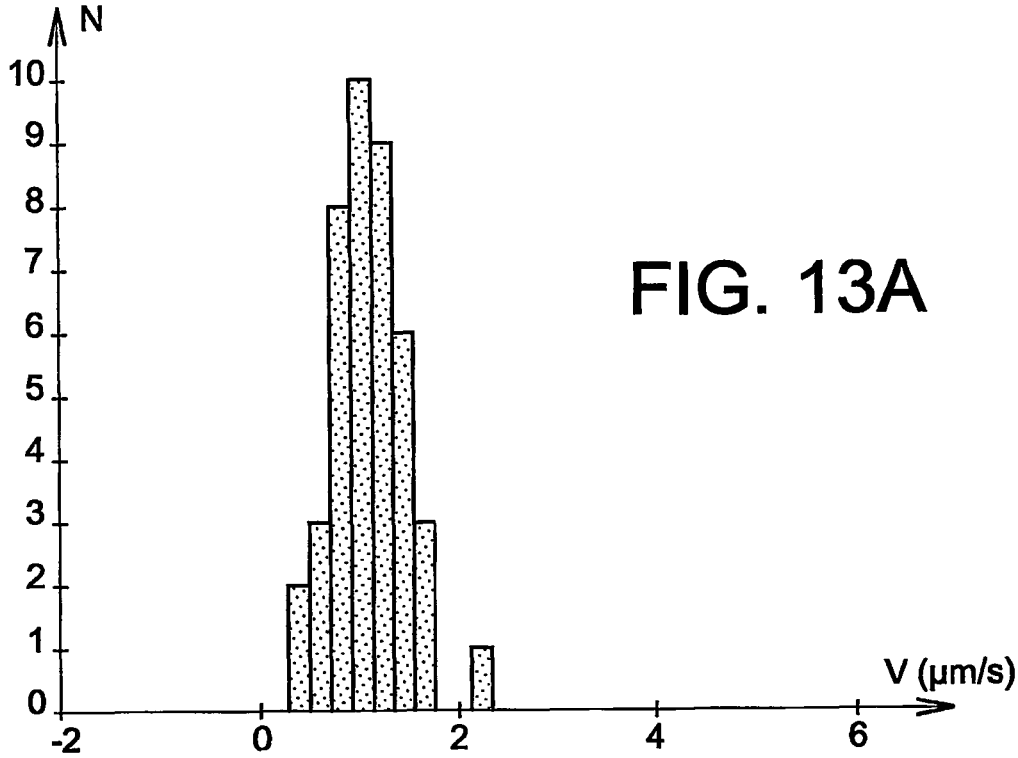
FIGS. 13A and 13B show histograms of displacement velocities of gold. particles for two different polarisations.
Figure 13B:
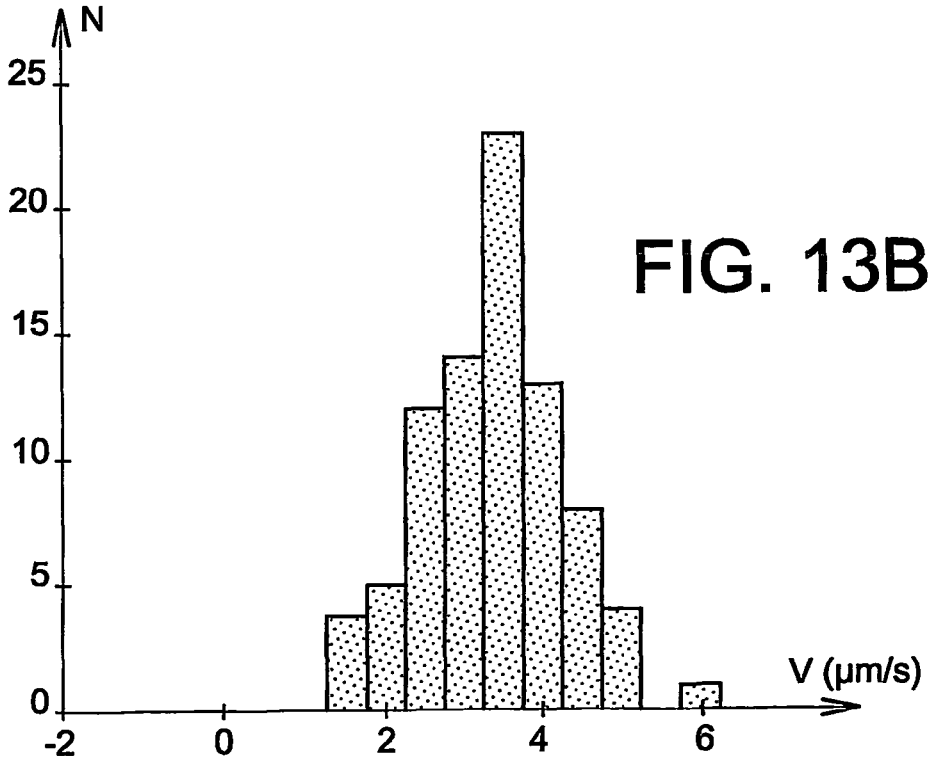

Furthermore, it is observed that the polarisation of light propagated in a guide has an influence on the average velocities of metallic particles (for example gold particles of 1 μm diameter). FIGS. 13A and 13B each show a histogram of gold ball displacement velocities in TE polarisation for FIG. 13A, for which the average velocity is 1.07 μm/s ±0.35 and in TM polarisation for FIG. 13B, for which the average velocity is 3.46 μm/ s ±0.81.

Therefore, the results indicate a displacement velocity approximately 3 times greater for TM (transverse magnetic) mode than for TE (transverse electrical) mode. Therefore, for equal injection power, polarisation of light injected into the waveguide can significantly modify the velocity of gold particles.

Once again, these results may advantageously be used in the context of a method according to the invention, due to the improved sort that is possible due to the polarisation effect.

The invention claimed is:

1. A method for sorting particles, comprising:

marking the particles, to modify their optical index;

placing the particles on at least one waveguide of a support; and injecting light radiation through the waveguide, causing displacement of particles on the waveguide and separation of the particles.

2. A method according to claim 1, wherein the radiation inserted in the waveguide is polarized in a transverse magnetic mode.

3. A method according to claim 1, wherein the particles are immersed in a liquid medium.

4. A method according to claim 1, wherein the particles form clusters on the waveguide.

5. A method according to claim 1, wherein the sorted particles have identical compositions but different sizes.

6. A method according to claim 1, wherein the sorted particles have a same or approximately a same size but different compositions.

7. A method according to claim 1, wherein the particles are cells or macromolecules or microballs.

8. A method according to claim 1, wherein the radiation is in a spectral range between the near ultraviolet and infrared.

9. A method according to claim 1, wherein the particles are microballs, and microball marked cells, and the radiation is located in the infrared range.

10. A method according to claim 1, wherein some particles are metallic or marked by metallic particles.

11. A method according to claim 10, wherein some particles are gold particles or are marked by gold particles.

* * * * *